US005546924A

United States Patent [19]

Todd

[11] Patent Number: 5,546,924

[45] Date of Patent: Aug. 20, 1996

[54] BOW STRING RELEASE DEVICE

[76] Inventor: Gary J. Todd, 33551 Giftos, Clinton Township, Mich. 48035

[21] Appl. No.: 255,391

[22] Filed: Jun. 8, 1994

[51] Int. Cl.[6] ..... F41B 5/18

[52] U.S. Cl. ..... 124/35.2; 124/31

[58] Field of Search ..... 124/35.2, 35.1, 124/31

[56] References Cited

U.S. PATENT DOCUMENTS

| | | | |
|---|---|---|---|
| 2,977,952 | 4/1961 | Gabriel et al. | 124/35.2 |
| 4,105,011 | 8/1978 | Chism . | |
| 4,151,825 | 5/1978 | Cook . | |
| 4,257,386 | 3/1981 | Gazzara . | |
| 4,282,851 | 8/1981 | Lyons . | |
| 4,403,594 | 9/1983 | Todd . | |
| 4,527,536 | 7/1985 | Smith . | |
| 4,926,835 | 5/1990 | Peck . | |
| 5,067,472 | 11/1991 | Vogel et al. . | |
| 5,076,251 | 12/1991 | Peck . | |
| 5,078,116 | 1/1992 | Peck . | |
| 5,170,771 | 12/1992 | Peck . | |
| 5,247,921 | 9/1993 | Todd . | |
| 5,357,939 | 10/1994 | Tentler et al. | 124/35.2 |
| 5,370,102 | 12/1994 | Peck | 124/35.2 |

*Primary Examiner*—Anthony Knight

*Attorney, Agent, or Firm*—Charles W. Chandler

[57] ABSTRACT

A bow string release device for providing a low friction, accurate, short release motion for releasing a bow string of an archery bow so that premature releasing of the bow string is prohibited, regardless of the force applied by the bow string. The bow string release device provides a pair of opposed carriers that rotatably support a pair of opposed rollers. The carriers are pivotally connected to a support body for pivotally moving between a closed position, where the rollers are held in contact to retain the bow string, and an open position, where the bow string is allowed to pass between the rollers. The rollers provide a linear contact surface with the bow string so that the bow string does not unduly wear. A linkage assembly provides two linkage members that are pivotally connected to the carriers. A trigger provides a roller that rollingly engages the linkage assembly for moving the carriers between the closed position and the open position. The rolling engagement of the linkage assembly reduces the force required and the friction created to release the bow string from the bow string release device. The trigger is spring biased toward the closed position, and the trigger is adjacent the end of a carrier and a portion of the linkage assembly in the closed position so that the bow string release device cannot prematurely release the bow string, regardless of the force applied by the bow string.

23 Claims, 2 Drawing Sheets

BOW STRING RELEASE DEVICE

FIELD OF THE INVENTION

The present invention relates to archery equipment and, more particularly, to a bow string release device that releases a bow string of an archery bow.

BACKGROUND OF THE INVENTION

In the sport of archery, the bow string is grasped by the ends of the archer's fingers and drawn back to tension the bow. Upon releasing the bow string, the high stress placed on the archer's fingers may produce bow string deviations that reduce the accuracy and velocity of the arrow. Repetitive drawing and releasing of the bow string by the fingers may lead to sore or callused fingers. For these reasons, many prior art devices have been devised to mechanically grasp a bow string so that the bow string can be drawn back and mechanically released.

Many bow string releases found in the prior art retain the bow string in a notch by means of a finger or keeper closing an exit from the notch. Since this finger will become angled with respect to the bow string path as the bow string is released, it may exert a slight lateral force on the bow string which, to a skilled archer, will result in a less than perfect release.

Some bow string releases utilize opposing fingers or jaw structures to retain the bow string. Such fingers and jaws may impose lateral forces on the bow string during the release of the bow string, or one jaw or finger may release slightly in advance of the other jaw or finger thus slightly biasing the bow string release. Also, the surfaces on the jaws or fingers can have a slightly different surface smoothness or curvature, which may slightly effect the bow string release or may unduly wear the bow string.

Other bow string release devices provide sensitive actuating mechanisms to provide a sensitive trigger but do not provide adjustment mechanisms for adjusting the sensitivity of the trigger. Such release devices may cause the bow string holding means to open prematurely when subjected to a large bow string force, especially when bows of different draw weights are utilized.

SUMMARY OF THE INVENTION

The present invention solves the above problems by providing a bow string release device that provides a low friction, accurate, short release motion for releasing a bow string while assuring that the bow string cannot prematurely be released regardless of the draw force applied by the bow string.

In the preferred embodiment, the present invention provides a pair of opposed carriers pivotally connected to a support body. A pair of rollers are rotatably supported by the carriers and are allowed to freely rotate about a vertical axis. The carriers pivot to move the rollers between a closed position, wherein the rollers are held in contact to retain the bow string, and an open position, wherein the rollers are separated to allow the bow string to pass between the rollers. The rollers provide a low friction, even release of the bow string while providing a linear contact surface with the bow string so that the bow string does not unduly wear.

The carriers are pivoted by a linkage assembly that provides two linkage members that are each pivotally connected to rear ends of the carriers. The two linkage members are in turn pivotally connected to each other to provide a three pivot axis assembly for pivotally moving the carriers between the closed position and the open position. When the two linkage members are linearly aligned between the rear ends of the carriers, the carriers are prohibited from pivoting towards the open position. When the two linkage members are non-linearly aligned, the carriers are free to pivot towards the open position.

A trigger is pivotally connected to the support body, and a roller is rotatably connected to the trigger for cooperatively engaging an extending arm member of the linkage assembly. The trigger is biased towards the closed position, and upon pulling the trigger, the roller on the trigger rollingly engages the extending arm of the linkage assembly thereby pivoting the two linkage members into a non-linear alignment so that the carriers may pivot toward the open position. The combination of the linkage assembly and the rolling engagement thereof provides a low friction, short release motion that minimizes the force required to release the bow string. A set screw extends through the trigger and abuts the extending arm of the linkage assembly to provide an adjustment for the sensitivity of the trigger by adjusting the distance the trigger must travel before releasing the bow string. When in the closed position, the trigger abuts the rear end of one of the carriers and a portion of the linkage assembly to prohibit the release device from prematurely releasing the bow string. The support body is pivotally connected to a strap that secures the release device to an archer's hand.

To this end, the objects of the present invention are to provide a new and improved bow string release device that provides a low friction, accurate, short release motion for releasing a bow string of an archer's bow; to provide a new and improved bow string release device that minimizes the force required to release the bow string; to provide a new and improved bow string release device that will not open prematurely regardless of the force applied by the bow string; and to provide a new and improved bow string release device that does not unduly wear the bow string.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawers wherein like reference numerals refer to like parts throughout the several views, and wherein.

DESCRIPTION OF THE PREFERRED EMBODIMENT

Figure 1:
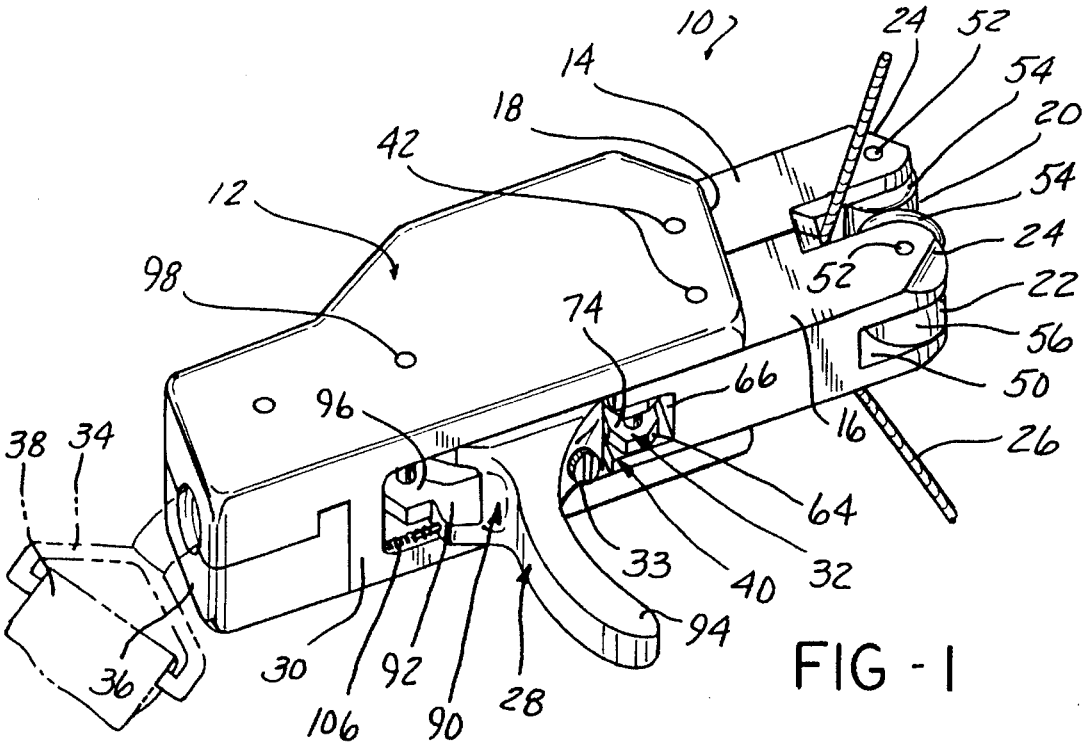
FIG. 1 is a perspective view of the present invention showing the rollers retaining a bow string in the closed position.

FIG. 1 shows a perspective view of the bow string release device 10 of the present invention. The bow string release device 10 provides a support body 12 for supporting and housing the internal mechanisms of the bow string release device 10. The support body 12 has a substantially rectangular hollow frame structure with rounded edges that allow for easy grasping of the support body 12 by an archer's hand (not shown). A pair of opposed carriers 14, 16 extend outward from a front end 18 of the support body 12, and the carriers 14, 16 rotatably support a pair of opposed rollers 20, 22, respectively, at front ends 24 of the carriers 14, 16. The carriers 14, 16 pivotally move between a closed position, wherein the rollers 20, 22 contact one another to retain a bow string 26, and an open position, wherein the rollers 20, 22 separate to allow the bow string 26 to pass between the rollers 20, 22. A trigger 28 extends laterally outward from a side 30 of the support body 12, and upon pulling back on the trigger 28, the trigger 28 engages a linkage assembly 32 for pivoting the carriers 14, 16 toward the open position. A set screw 33 extends through the trigger 28 and abuts the linkage assembly 32 to provide an adjustment as to the distance the trigger 28 must travel before pivoting the carriers 14, 16 to the open position. When the trigger 28 is released, the trigger 28 and carriers 14, 16 are urged back to the closed position. A buckle 34 is pivotally connected at the rear end 36 of the support body 12, and a strap 38 is connected to the buckle 34 for securing the bow string 10 release device to the archer's hand. The pivotal connection of the buckle 34 to the support body 12 allows the archer (not shown) to adjust his hand position to the bow string release device 10.

Figure 2:
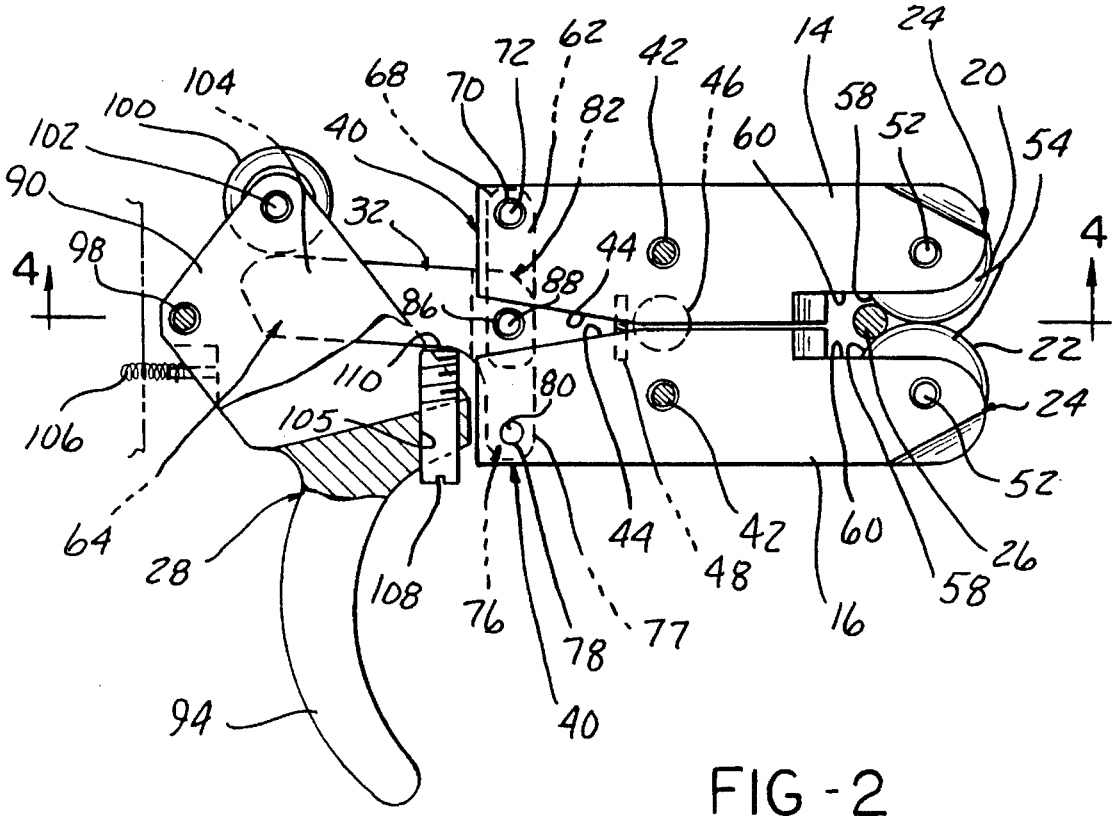
FIG. 2 is a top view of the bow string release device With some parts broken away showing the internal mechanisms of the bow string release device in the closed position.
Figure 3:
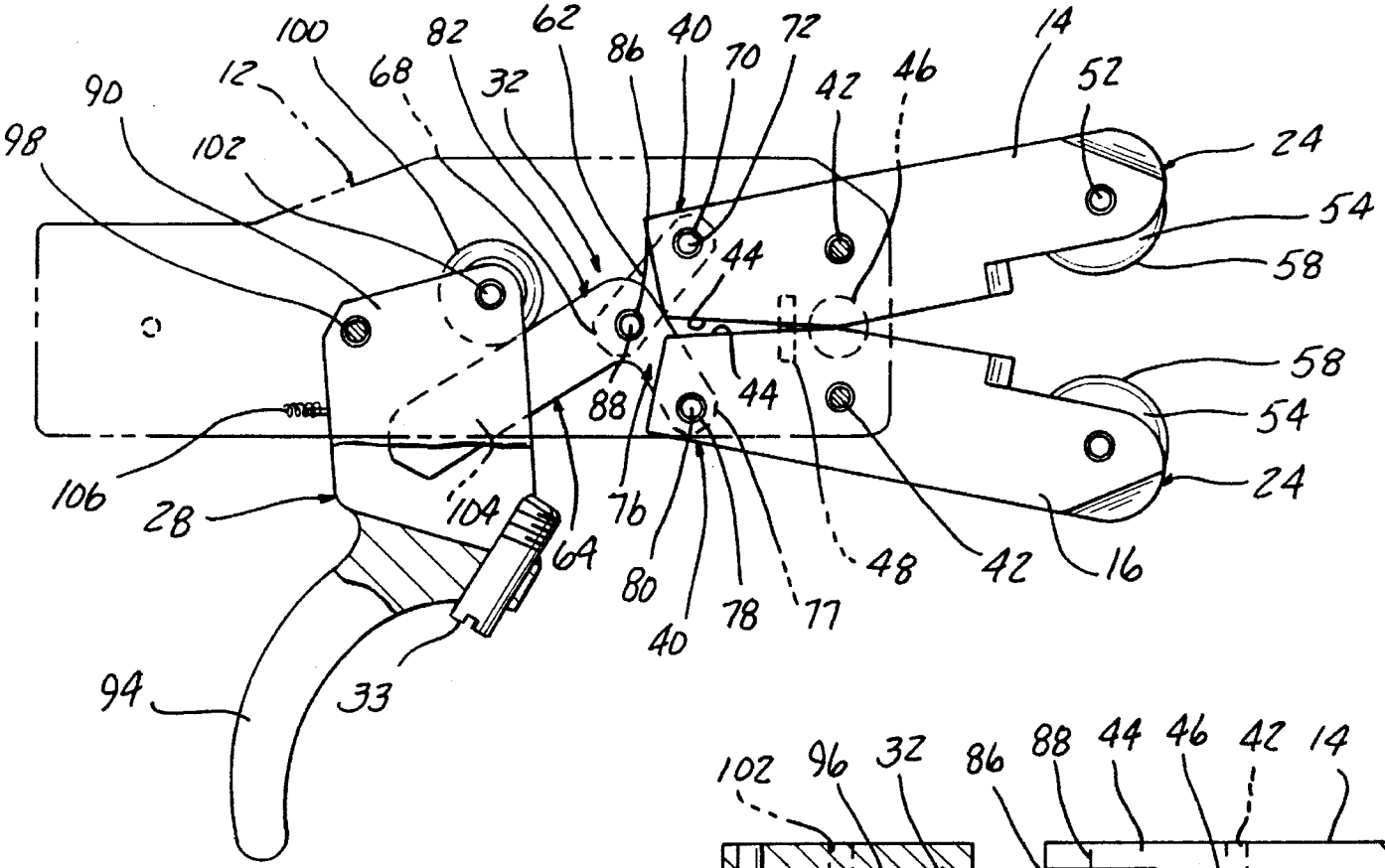
FIG. 3 is a top view of the bow string release device with some parts broken away showing the internal mechanisms of the bow string release device in the open position.

To provide a low friction and even release of the bow string 26, the pair of opposed carriers 14, 16 have their front ends 24 extending outward from the support body 12 and their rear ends 40 housed within the support body 12, as seen in FIG. 1. The carriers 14, 16 are pivotally connected to the support body 12 between the front ends 24 and the rear ends 40 of the carriers 14, 16. Aligned apertures (not shown) are provided through the support body 12 and the carriers 14, 16, and pivot pins 42 are press fit in the aligned apertures to provide pivotal movement of the carriers 14, 16 between the closed position and the open position. As seen in FIGS. 2 and 3, the rear ends 40 of the carriers 14, 16 have opposed surfaces 44 that taper away from each other when in the closed position so that the front ends 24 of the carriers 14, 16 may pivot away from each other while the tapered surfaces 44 of the rear ends 40 of the carriers 14, 16 pivot toward each other to establish the open position.

Figure 4:
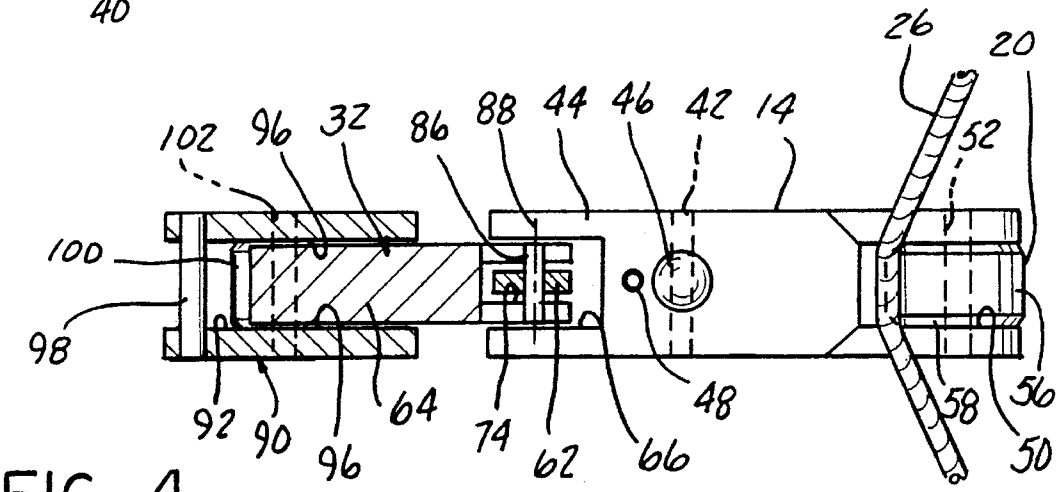
FIG. 4 is a sectional view in the direction of arrows 4–4 in FIG. 2 showing the floating bearing and axial compression spring disposed between the carriers.

To reduce friction when the carriers 14, 16 are pivoting between the open position and the closed position, a floating bearing 46 is disposed between the opposed carriers 14, 16, as seen in FIG. 4. The floating bearing 46 is in axial alignment with the pivot pins 42 that pivotally connect the carriers 14, 16 to the support body 12. Each carrier 14, 16 provides complimentary hemispherical recesses (not shown) for housing the floating bearing 46.

To provide for quick reloading after releasing the bow string 26, the bow string release device 10 is biased toward the closed position, as seen in FIG. 2. An axial compression spring 48 is disposed between the carriers 14, 16 between the floating bearing 46 and the rear ends 40 of the carriers 14, 16, as seen in FIGS. 3 and 4. The axial compression spring 48 urges the rear ends 40 of the carriers 14, 16 away from each other which in turn biases the front ends 24 of the carriers 14, 16 toward each other toward the closed position.

In order to avoid lateral forces being applied to the bow string 26 during its release and to avoid undue wear of the bow string 26, the rollers 20, 22 are rotatably supported at the front ends 24 of the carriers 14, 16, as seen in FIGS. 1–4. The front ends 24 of each of the carriers 14, 16 are bifurcated to define transverse slots 50 extending therethrough. The front ends 24 of the carriers 14, 16 have apertures (not shown) extending therethrough and are aligned with apertures (not shown) provided through a vertical axis (not shown) of the rollers 20, 22. Pivot pins 52 are press fit in the aligned apertures to rotatably support the rollers 20, 22 within the transverse slots 50 of the front ends 24 of the carriers 14, 16 and allow the rollers 20, 22 to freely rotate about their vertical axis. The rollers 20, 22 have substantially flat sides 54 that are substantially parallel to the bifurcated front ends 24 of the carriers 14, 16 that define the transverse slots 50. The rollers 20, 22 have peripheries 56 that are substantially parallel to their vertical axis so that the peripheries 56 engage the bow string 26 in a plane parallel to the rollers' rotational axes. This avoids lateral forces that may be applied to the bow string 26 when the bow string 26 passes between the rollers 20, 22. The edges 58 of the rollers 20, 22 are beveled to better distribute the load on the bow string 26 where the bow string 26 bends and changes direction at the rollers 20, 22 upon the bow string 26 being restrained by the rollers 20, 22, as seen in FIG. 4. When the bow string 26 is released, the rollers 20, 22 roll in opposite directions in the direction of the movement of the bow string 26 in order to reduce friction.

To provide an area to accommodate the retention of the bow string 26, each of the carriers 14, 16 has complementary recesses 60 on the front ends 24 of the carriers 14, 16 so that the front ends 24 of the carriers 14, 16 do not contact one another, as seen in FIG. 2. The complementary recesses 60 provided in the carriers 14, 16 allow the peripheries 56 of the rollers 20, 22 to contact one another when in the closed position. The recesses 60 in the carriers 14, 16 provide an area behind the rollers 20, 22 to accommodate and retain the bow string 26 in the closed position. The peripheries 56 of the rollers 20, 22 provide a linear contact surface on the bow string 26 which is less apt to wear the bow string 26 as compared to a point contact surface.

In order for the bow string release device 10 to have a sensitive trigger 28, the distance the trigger 28 must travel to release the bow string 26 should be short. To accomplish this, the linkage assembly 32 for the bow string release device 10 provides two linkage members 62, 64 for pivotally moving the carriers 14, 16 and rollers 20, 22 between the closed position, as seen in FIG. 2, and the open position, as seen in FIG. 3. The rear ends 40 of the carriers 14, 16 are also bifurcated to define transverse slots 66 therethrough with apertures (not shown) extending therethrough, as seen in FIGS. 1 and 4. As seen in FIGS. 2 and 3, the first linkage member 62 is substantially rectangular with beveled corners 68. The first linkage member 62 has an aperture (not shown) extending through each of its ends and is pivotally connected to the rear end 40 of carrier 14 by having a pivot pin 70 inserted through the aligned apertures of the rear end 40 of the carrier 14 and one end of the first linkage member 62 to establish a first pivot axis 72.

The second linkage member 64 has an L-shaped configuration with a transverse slot 74 extending through a short leg 76 of the L-shaped configuration, as seen in FIGS. 2–4. One end of the short leg 76 of the L-shaped configuration of the second linkage member 64 has an aperture (not shown) extending therethrough and is pivotally connected to the rear end 40 of the carrier 16 that is not connected to the first linkage member 62. A pivot pin 78 extends through an aperture (not shown) provided in the rear end 40 of the carrier 16 and through the aperture provided in the short leg 76 of the L-shaped second linkage member 64 to establish a second pivot axis 80.

Another aperture (not shown) is provided through a corner 82 of the L-shaped configuration of the second linkage member 64. The end of the first linkage member 62 not connected to the carrier 14 slidably engages the transverse slot 74 of the second linkage member 64 and is pivotally connected to the second linkage member 64 by a pivot pin 86 extending through the aperture in the corner 82 of the second linkage member 64 and through the aperture provided in the first linkage member 62 to establish a third pivot axis 88. The first linkage member 62 and second linkage member 64 interact as a toggle joint so that when the three pivot axes 72, 80, 88 of the two linkage members 62, 64 are linearly aligned, as seen in FIG. 2, the two linkage members 62, 64 act as a rigid member to prohibit the rear ends 40 of the carriers 14, 16 from moving toward each other, thereby prohibiting the carriers 14, 16 from moving toward the open position. When the third pivot axis 88 is not linearly aligned with the first pivot axis 72 and the second pivot axis 80, as seen in FIG. 3, then the two linkage members 62, 64 are free to move, and the rear ends 40 of the carriers 14, 16 may pivot toward each other while the third pivot axis 88 pivots away from the carriers 14, 16. When the rear ends 40 of the carriers 14, 16 are allowed to move towards each other, the carriers 14, 16 may move toward the open position.

The trigger 28 has a bifurcated body portion 90 that defines a transverse slot 92, as seen in FIGS. 1 and 4. The trigger 28 also has an arcuate arm 94 that is integral with and extends from the body portion 90 of the trigger 28 while also extending outward from the side 30 of the support body 12. The bifurcated body portion 90 provides a pair of opposed and substantially parallel walls 96 with an aperture (not shown) extending therethrough. Corresponding apertures (not shown) in the support body 12 align with the apertures in the bifurcated body portion 90 of the trigger 28 to allow for the press fitting of a pivot pin 98 to provide pivotal movement of the trigger 28 relative to the support body 12.

To minimize the friction created and the force required to release the bow string 26, the trigger 28 has a roller 100 rotatably connected between the opposed walls 96 of the bifurcated body portion 90 of the trigger 28 by a pivot pin 102 extending through corresponding apertures (not shown) of the body portion 90 of the trigger 28 and the roller 100, as seen in FIGS. 2–4. A long leg 104 of the L-shaped configuration of the second linkage member 64 extends away from the carriers 14, 16 and slidably engages the opposed walls 96 of the body portion 90 of the trigger 28. The roller 100 of the trigger 28 rollingly engages the long leg 104 of the second linkage member 64 upon the trigger 28 being pulled and pivoted toward the open position. The rolling engagement of the roller 100 on the long leg 104 of the second linkage member 64 provides a low friction engagement of the carriers 14, 16 that requires a minimal amount of force to move the third pivot axis 88 away from the carriers 14, 16 and out of linear alignment with the first pivot axis 72 and the second pivot axis 80.

In order for the bow string release device 10 to release the bow string 26, the trigger 28 must travel a certain distance before the roller 100 engages the long leg 104 of the second linkage member 64, and the third pivot axis 88 is pivoted out of linear alignment with the first and second pivot axes 72, 80, respectively, thus allowing the carriers 14, 16 to pivot toward the open position. As seen in FIG. 2, the set screw 33 adjusts the distance the trigger 28 must travel before the bow string 26 is released by providing a positive stop against the long leg 104 of the second linkage member 64. The set screw 33 is threaded through a threaded aperture 105 provided in the corner of the trigger 28 that abuts the rear end 40 of the carrier 16. The slotted end 108 of the set screw 33 faces outward away from the bow string release device 10 so that the set screw 33 is easily accessible for adjustment. The non-slotted end 110 of the set screw 33 abuts the long leg 104 of the second linkage member 64 and provides a positive stop for limiting the travel of the trigger 28 toward the closed position. By threading the set screw 33 inward, toward the long leg 104 of the second linkage member 64, the distance the trigger 28 must travel to release the bow string 26 is reduced, and therefore, the sensitivity of trigger 28 is increased. By threading the set screw 33 outward, away from the long leg 104 of the second linkage member 64, the distance the trigger 28 must travel to release the bow string 26 is increased, and therefore, the sensitivity of the trigger 28 is decreased. The set screw 33 is adjusted per the archer's personal preference.

To bias the trigger 28 towards the closed position, an axial compression spring 106 is provided between the trigger 28 and the support body 12 to urge the trigger 28 towards the carriers 14, 16, as seen in FIGS. 1–3. When in the closed position, as seen in FIGS. 1–2, the trigger 28 is adjacent the rear end 40 of one 16 of the carriers 14, 16 so that the carriers 14, 16 cannot pivot toward the open position by prohibiting the rear ends 40 of the carriers 14, 16 from moving towards each other. The set screw 33 also abuts the second linkage member 64 to maintain linear alignment of the first, second and third pivot axes 72, 80, 88, respectively, to assure that the bow string release device 10 cannot prematurely release the bow string 26 when in the closed position, regardless of the force applied by the bow string 26.

To operate the bow string release device 10, the arcuate arm 94 of the trigger 28 is pulled back by the archer's finger thus pivoting the linkage assembly 32, carriers 14, 16 and rollers 20, 22 to the open position, as seen in FIG. 3. The bow string release device 10 is orientated so that the rollers 20, 22 lie in a horizontal plane, and the arcuate arm 94 of the trigger 28 is laterally disposed from the support body 12 in the same horizontal plane as the rollers 20, 22. The bow string 26 is passed between the rollers 20, 22, and the trigger 28 is released to allow the carriers 14, 16 and rollers 20, 22 to bias back to the closed position to retain the bow string 26, as seen in FIGS. 1–2. Once in the closed position, the archer pulls back on the support body 12 until the bow string 26 is drawn to provide the proper tension in the bow (not shown). The archer then takes aim, and the trigger 28 is slowly pulled back until the carriers 14, 16 and rollers 20, 22 move to the open position, and the bow string 26 is allowed to pass between the rollers 20, 22. To reload the bow string 26, the same procedure is repeated.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A bow string release device for releasing a bow string of an archery bow comprising:

a support body;

a pair of carriers pivotally connected to said support body;

a pair of rollers supported by said carriers for movement between a closed position, wherein a bow string is retained by said rollers, and an open position, wherein the bow string is permitted to pass between said rollers;

a linkage assembly pivotally connected to said pair of carriers for pivotally moving said carriers between said closed position and said open position; and means for manually actuating said linkage assembly for movement between said closed position and said open position.

2. The bow string release device stated in claim 1, wherein said linkage assembly comprises two linkage members that are pivotally connected for movement between said closed position and said open position.

3. The bow string release device stated in claim 1, wherein said means for manually actuating said linkage assembly comprises a trigger pivotally connected to said support body and cooperatively engaging said linkage assembly for movement between said closed position and said open position.

4. The bow string release device stated in claim 3, further comprising:

means for adjusting sensitivity of the trigger by adjusting the distance the trigger must travel between the closed position and the open position.

5. The bow string release device stated in claim 4, wherein the means for adjusting sensitivity of the trigger comprises:

a set screw threadably inserted through a threaded aperture provided in said trigger, and said set screw having one end abut said linkage assembly and another end accessible for adjustment.

6. The bow string release device stated in claim 1, including means for biasing said pair of carriers towards said closed position.

7. The bow string release device stated in claim 1, including a floating bearing member disposed between said pair of carriers in axial alignment with the pivotal connections of said pair of carriers to said support body.

8. The bow string release device stated in claim 1, including a strap pivotally connected to said support body for securing said bow string release device to an archer's hand.

9. The bow string release device stated in claim 1, including said pair of rollers having a rotational axis perpendicular to the motion of the bow string during the release of the bow string such that said pair of rollers roll in opposite directions upon the bowstring being released.

10. A bow string release device for releasing a bow string of an archery bow comprising:

a support body;

a pair of opposed carriers having a front end and a rear end, and said pair of opposed carriers pivotally connected to said support body between said front end and said rear end;

a pair of rollers rotatably supported by said front end of said carriers, and said rollers moving with said carriers for movement between a closed position, wherein a bow string is retained by said pair of rollers, and an open position, wherein said bow string is permitted to pass between said pair of rollers;

means for biasing said pair of carriers towards said closed position;

a linkage assembly pivotally connected to said rear end of said pair of opposed carriers for pivotally moving said carriers between said closed position and said open position;

a trigger pivotally connected to said support body and cooperatively engaging said linkage assembly for pivotally moving said carriers between said closed position and said open position; and means for biasing said trigger toward said closed position.

11. The bow string release device stated in claim 10, wherein said linkage assembly comprises a first linkage member pivotally connected to a rear end of one of said pair of opposed carriers, and a second linkage member pivotally connected to said rear end of the other of said pair of carriers, and said first linkage member and said second linkage member pivotally connected to one another for movement between said closed position and said open position.

12. The bow string release device as stated in claim 10, including a third roller rotatably connected to said trigger for rollingly engaging said linkage assembly for movement between said closed position and said open position.

13. The bow string release device as stated in claim 10, wherein said means for biasing said pair of opposed carriers comprises an axial compression spring between said rear end of said pair of opposed carriers and said pivotal connection of said pair of opposed carriers to said support body, and said axial compression spring urging said rear end of said carriers away from each other.

14. The bow string release device stated in claim 10, further comprising:

means for adjusting sensitivity of said trigger by adjusting the distance said trigger must travel between the closed position and the open position.

15. The bow string release device stated in claim 14, wherein said means for adjusting sensitivity of said trigger comprises:

a set screw threadably inserted through a threaded aperture provided in said trigger, and said set screw having one end abut said linkage assembly and another end accessible for adjustment.

16. The bow string release device as stated in claim 10, wherein said means for biasing said trigger comprises an axial compression spring between said trigger and said support body urging said trigger toward said pair of opposed carriers.

17. The bow string release device stated in claim 10, including a floating bearing member disposed between said pair of carriers in axial alignment with the pivotal connection of said pair of opposed carriers to said support body.

18. The bow string release device stated in claim 10, including a strap pivotally connected to said support body for securing said apparatus to an archer's hand.

19. The bow string release device stated in claim 10, including said pair of rollers having a rotational axis perpendicular to the motion of the bow string during the release of the bow string such that the pair of rollers roll in opposite directions upon the bow string being released.

20. A bow string release device for releasing a bow string of an archery bow comprising:

a support body;

a pair of opposed carriers having a front end and a rear end, and said pair of opposed carriers pivotally connected to said support body between said front end and said rear end of said carriers, and said front end of said carriers having a transverse slot extending therethrough;

a pair of rollers rotatably supported in said transverse slots of said front end of said pair of opposed carriers, and said pair of rollers moving with said carriers between a closed position, wherein a bow string is retained by said pair of rollers, and an open position, wherein said bow string is permitted to pass between said pair of rollers;

an axial compression spring between said rear end of said pair of carriers and said pivotal connection of said carriers to said support body for biasing said carriers toward said closed position;

a floating bearing disposed between said pair of carriers in axial alignment with the pivotal connections of said pair of carriers to said support body for providing low friction pivotal movement of said pair of carriers;

a linkage assembly having a first linkage member pivotally connected to said rear end of one of said pair of carriers to form a first pivot axis, and a second linkage member pivotally connected to said rear end of said other of said pair of carriers to form a second pivot axis, and said first linkage member and said second linkage member pivotally connected to each other to form a third pivot axis for movement between a closed position, wherein said first pivot axis, said second pivot axis and said third pivot axis linearly align to prohibit said carriers from pivoting toward said open position, and an open position, wherein said third pivot axis is non-linearly aligned with said first pivot axis and said second pivot axis to allow said carrier to pivot between said open position and said closed position;

said second linkage member of said linkage assembly having an integral arm extending beyond said pivotal connection of said first linkage member and said second linkage member and extending away from said pair of opposed carriers;

a trigger pivotally connected to said support body, and said trigger having a third roller rotatably connected to said trigger for rollingly engaging said arm of said second linkage member for moving said linkage assembly between said open position and said closed position;

means for adjusting sensitivity of said trigger by adjusting the distance said trigger must travel between the closed position and the open position; and a second axial compression spring between said trigger and said support body for urging said trigger toward said closed position wherein said trigger positively engages said rear end of one of said pair of carriers and prohibits said one carrier from pivoting towards said open position.

21. The bow string release device as stated in claim 20 wherein said means for adjusting sensitivity of said trigger comprises:

a set screw threadably inserted through a threaded aperture provided in said trigger, and said set screw having one end abut said integral arm of said second linkage member and another end accessible for adjustment.

22. The bow string release device as stated in claim 20, including a strap pivotally connected to said support body for securing said apparatus to said archer's hand.

23. The bow string release device as stated in claim 20, including said pair of rollers having a rotational axis perpendicular to the motion of the bow string during release of the bow string such that said pair of rollers roll in opposite directions upon the bow string being released.

* * * * *